United States Patent [19]

Romine et al.

[11] Patent Number: 4,834,859

[45] Date of Patent: May 30, 1989

[54] DIAPHRAGM CELL CATHODE ASSEMBLY

[75] Inventors: Richard L. Romine, Concord; L. C. Curlin, Painesville, both of Ohio

[73] Assignee: OxyTech Systems, Inc., Chardon, Ohio

[21] Appl. No.: 180,508

[22] Filed: Apr. 12, 1988

[51] Int. Cl.[4] ..... C25B 9/04

[52] U.S. Cl. ..... 204/242; 204/252; 204/253; 204/267; 204/279; 204/290 R

[58] Field of Search ..... 204/252–258, 204/263–266, 279, 290 R

[56] References Cited

U.S. PATENT DOCUMENTS 3,390,072 6/1968 Wiseman ..... 204/266

3,755,108 8/1973 Raetzsch et al. ..... 204/255 X 3,849,280 11/1974 Raetzsch et al. ..... 204/254 X 4,339,323 7/1982 Dilmore et al. ..... 204/256

*Primary Examiner*—Donald R. Valentine

*Attorney, Agent, or Firm*—John J. Freer

[57] ABSTRACT

A diaphragm cell cathode assembly has improved current distribution to a tube sheet distributing electrical current to cathode tubes. Electrical current is fed to the diaphragm cell assembly by grid bars connected to side plates. The current must then flow the side plates to the inner tube sheets, the tube sheets and side plates being generally in spaced apart, planar parallel relationship to one another. Assembly temperature uniformity, as well as temperature reduction, is now enhanced by providing supplemental distributor bars at the upper and lower regions of the grid bars, and in electrical connection between side plates and tube sheets.

9 Claims, 3 Drawing Sheets

DIAPHRAGM CELL CATHODE ASSEMBLY

BACKGROUND OF THE INVENTION

It has been known in diaphragm cells to feed current into the cathodes initially through grid bars. The current travels from the grid bars through side plates and then across flanges through tube sheets which then distribute current to the cathode tubes. Thus in U.S. Pat. No. 3,390,072 there has been disclosed a diaphragm cell having grid bars for current distribution, which grid bars are secured, at about mid section of the outer surface, to the diaphragm cell side plates. Such side plates form a portion of the outer housing of the diaphragm cell. The current flow can then be continued in the manner as discussed hereinabove, i.e., through flanges to the tube sheets.

It has been known to provide plug welded rods between the side plates and the tube sheets which can reinforce these members of the cell. Such rods, located below the upper and lower flanges, can be welded to the outer face of the tube sheet, extend across the gap between side plate and tube sheet, and continue through holes in the side plate. The outer end of the rods are then welded to the side plate. Such rods, positioned thereby in a manner parallel to the flanges between the side plates and the tube sheets, may therefore provide supplemental current flow along with providing structural reinforcing characteristic.

It would nevertheless be desirable to provide for a more even cathode temperature distribution. Such could enhance economy of cathode operation as well as desirably contribute to current density distribution. It would be most desirable to obtain all of these benefits while retarding to eliminating any possibility of cell stress corrosin cracking.

SUMMARY OF THE INVENTION

There has now been provided a diaphragm cell side assembly providing enhanced cathode temperature uniformity. Additonally, such construction will supply desirable current flow and electrical conductivity. All of this has been achieved while not only reducing to eliminating the potential for distortion and stress corrosion cracking in the cell side assembly but also eliminating the need for perforating the cell side plate. Moreover, the present structure readily lends itself to installation, not only during new cell assembly, but also in cell recontsruction and replacement.

In a broad aspect, the invention is directed to an electrolytic cell of the diaphragm type useful for producing chlorine and caustic by the electrolysis of brine, wherein the cell comprises a housing containing outer end plates and outer side plates, with said side plates having a longitudinal, outer grid bar as a solid band extending along an outside face of the side plate, at substantially the mid-section thereof, and conducting electrical current to the side plate, and with the side plate in turn being in electrical connection by upper and lower inner flanges to an inner, current-carrying cathode tube sheet situated within the cell housing, with such upper and lower inner flanges extending from the outer side plate to the inner tube sheet and thereby forming a slot therebetween. Within the framework, the invention is most particularly directed to the improvement in providing side plate temperature uniformity as well as supplementing current flow to the cell, which improvement comprises an upper distributor bar in firm, electrically conductive connection to both an inner face of the side plate and an outer face of the tube sheet, such upper distributor bar being positioned within the slot and below the upper flange and in alignment with the upper edge of the grid bar, and a lower distributor bar in firm electrically conductive connection to both an inner face of the side plate and an outer face of the tube sheet within the slot, with such lower distributor bar being positioned above the lower flange and in alignment with the lower edge of the grid bar.

In another aspect, the invention is directed to a method for establishing a more uniform cell side plate temperature equilibrium.

DESCRIPTION OF THE PREFERRED EMBODIMENTS

The assembly for the application of this invention will be a cell such as a chlor-alkali cell more often referred to as a diaphragm cell. This cell will have a diaphragm located between anode and cathode as well as have, for supplying current to the cathode, an exterior source supplying current to a cell grid bar. Although other exterior current carrying source may be used, where a grid bar is employed, it will typically be wrapped around all sides of the cell, usually at about midpoint of each cell side plate and end plate.

Figure 1:
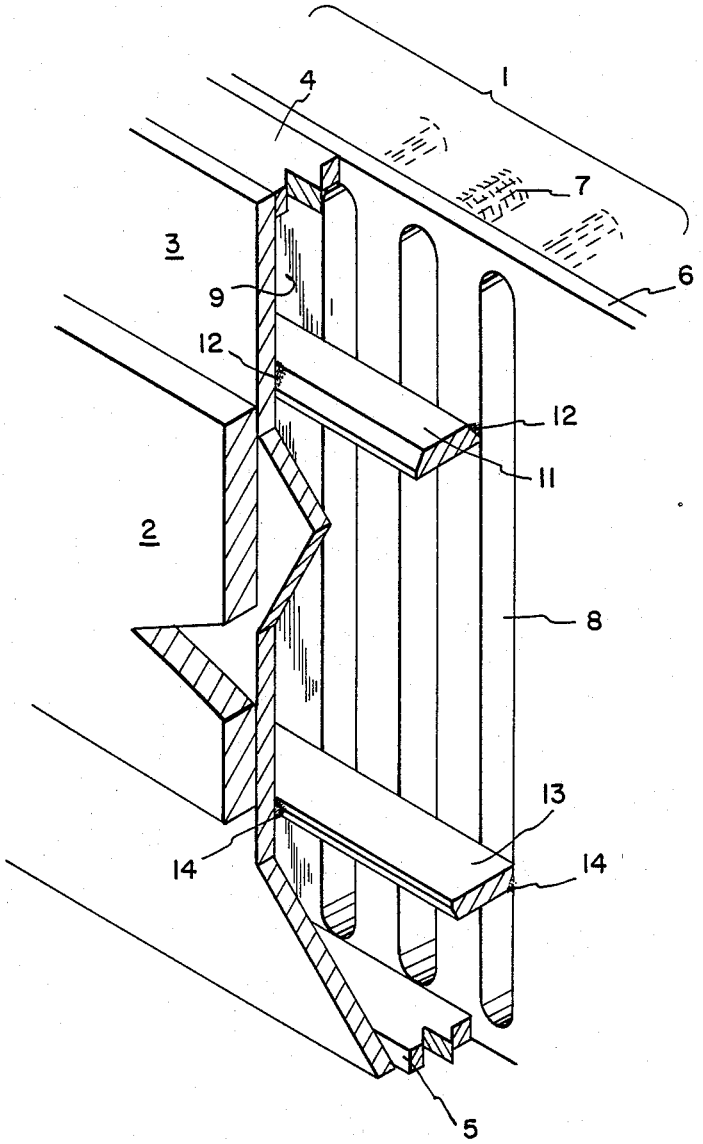
FIG. 1 is a front prospective view, in partial cutaway, of a side assembly of a diaphragm cell constructed in accordance with the present invention.

Reference for understanding the invention will now be made to the figures. In each figure the same element will be identified by the same number where possible. Referring more particularly to FIG. 1., there is shown in partial cutaway a portion of a side of a cell 1. At the exterior of the cell 1 is a current-carrying grid bar 2. The grid bar 2 carries current to a cell side plate 3. Through a top flange 4 and a bottom flange 5, current is carried from the side plate 3 to a tube sheet 6. On the side of the tube sheet 6 opposite the flanges 4, 5 are the cathode tubes 7. Each cathode tube 7 is situated beyond a tube sheet aperture 8. At the near side of the tube sheet 6, these apertures open to a side slot 9 formed between the cell side plate 3, tube sheet 6, and the flanges 4, 5.

Within the side slot 9, there is affixed a current-carrying upper bar 11. This upper bar 11 is secured by welds 12 to both the side plate 3 and the tube sheet 6. This current-carrying upper bar 11 is situated within the side slot 9 such that its lower surface is in a common plane with the upper edge of the grid bar 2. Below the current-carrying upper bar 11, and also in the side slot 9, is a current-carrying lower bar 13. This current-carrying lower bar 13 is likewise secured to the side plate 3 and tube sheet 6 by welds 14. The current-carrying lower bar 13 is situated in the side slot 9 such that its upper surface is in a plane parallel to the lower surface of the grid bar 2.

Figure 1A:
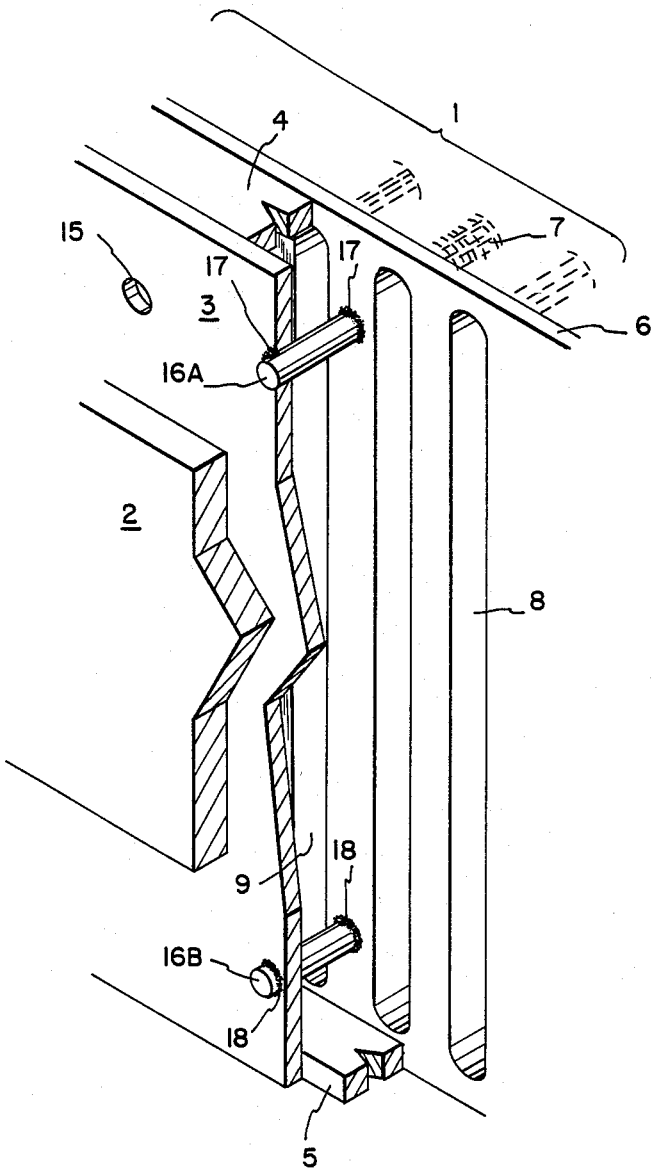
PRIOR ART FIG. 1A
FIG. 1A, is a portion of a prior art side assembly, in front perspective and partial cutaway, having structurally reinforcing welded rods.

Referring then to the FIG. 1A prior art assembly, a cell 1 has a grid bar 2, cell side plate 3, and connecting therefrom a top flange 4 and bottom flange 5 to a tube sheet 6. The tube sheet 6 has apertures 8 perforating through the sheet 6 to cathode tubes 7. Additionally, the side plate 3 has apertures 15 which extend from a side slot 9 through the side plate 3. Then extending across the side slot 9 from the tube sheet 6 through the apertures 15 of the side plate 3 are upper and lower support rods 16A and 16B. The upper support 16A is secured to the side plate 3 and tube sheet 6 by welds 17. Likewise the lower support rod 16B is similarly secured to the side plate 3 and tube sheet 6 by welds 18. In positioning, the support rods 16A and 16B are positioned essentially midway between the grid bar 2 and closest flange member.

Figure 2:
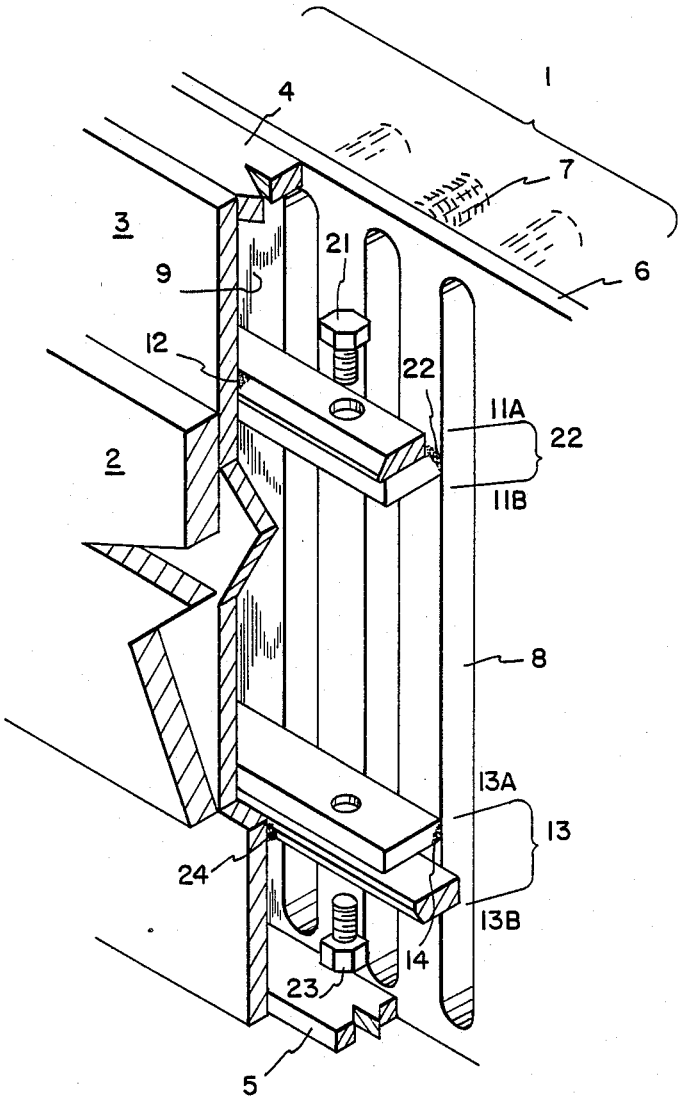
FIG. 2, is a front perspective view of a portion of a side assembly in patial cutaway having overlapping distributor bars according to the present invention.

Referring then to FIG. 2, a cell 1 has a grid bar 2 secured in current-carrying contact to a cell side plate 3. The side plate 3 is similarly in current-carrying contact with a top flange 4 and a bottom flange 5 for providing current to a tube sheet 6. The tube sheet 6 contains tube sheet apertures 8 behind each of which is a cathode tube 7. The side plate 3, top and bottom flanges 4, 5, and tube sheet 6 form a side slot 9.

Within the side slot 9, adjacent the zone at the top of the grid bar 2, is a current-carrying upper bar assembly 11 composed of a top bar 11A, a bottom bar 11B, and threaded connector 21. The top bar 11A is secured to the side plate 3 by welds 12. The bottom bar 11B is secured to the tube sheet 6 by welds 22. The threaded connector 21 then secures the top bar 11A to the bottom bar 11B. Similarly in the lower portion of the side slot 9, adjacent the zone of the lower surface of the grid bar 2, is a current-carrying lower bar assembly 13 composed of a top bar 13A, bottom bar 13B, and threaded connector 23. For this lower bar assembly 13, the top bar 13A is secured by welds 14 to the tube sheet 6 while the bottom bar 13B is secured by welds 24 to the side plate 3. The top and bottom bars 13A, 13B are then secured to each other by the threaded connector 23.

Referring again more particularly to FIG. 1, in assembly of the diaphragm cell, there can be installed the cathode tubes 7 within the inner portion of the cell confined by the tube sheet 6. Next the current-carrying upper and lower bars 11 and 13 are secured to the tube sheet 6 by welding 12, 14. The grid bar 2 can be secured to the cell side plate 3 as by welding or brazing. Then the cell side plate 3 is brought up against the current-carrying upper and lower bars 11, 13, in proper alignment, and the bars 11, 13 welded to the cell side by the welds 12, 14. Finally, the top and bottom flanges 4, 5 are installed at the top and bottom of the cell side slot 9. These flanges 4, 5 can be secured to both the cell side and the tube sheet, as by welding.

As shown in FIGS. 1 and 2, the bars 11 and 13 may have chamfered edges, and such can be bevelled toward either the top flange 4 or bottom flange 5. In addition to the apertures for the connectors 21, 23, the bars 11, 11A, 11B 13, 13A and 13B can contain apertures, as for the passage of hydrogen gas where such side assembly is utilized in a chlor-alkali cell. Similarly for such gas passage, the bars 11, 11A, 11B, 13, 13A and 13B may be slotted. In general, the cross-sectional shape of these bars will be any such shape as will provide for ready, secure attachement, in desirable current-carrying node, to both the side plate 3 and tube sheet 6. It is preferred that the side plates 3 and tube sheets 6 will be positioned in parallel planes separated by the side slot 9 although it is to be understood that differing, spaced apart relationship may be contemplated. Similarly, the upper and lower bars 11, 13 are preferably in alignment parallel to the grid bars 2. Moreover, these upper and lower bars 11, 13 will generally extend along the complete length of the tube sheet 6, although gaps may be provided to facilitate gas flow.

The grid bar 2 is made from a material of excellent current-carrying capability, e.g., a metal such as copper or aluminum. For good current-carrying characteristic, coupled with desirable resistance to cell environment, the cell side plate 3 and the top and bottom flanges 4, 5 will usually be made of a material such as mild steel. Within the cell, the tube sheet 6 which likewise needs to be resistant to the cell environment as well as offer good current-carrying characteristic is usually also made from mild steel. Cathode tube 7 can be fabricated from a porous steel such as a wire mesh cloth or perforated plate. For the current-carrying upper and lower bars 11, 11A, 11B, 13, 13A and 13B it will be typical to use a material such as mild steel. Welding for these bars 11, 11A, 11B, 13, 13A and 13B to the side plate 3 as well as to the tube sheet 6 can be accomplished by welding such as electric arc welding. In addition to welding, or along with welding, it is also comptemplated that the upper and lower bars 11, 11A, 11B, 13, 13A and 13B may be secured between the side plate 3 and tube sheet 6 by other means such as silver soldering. Also, where such bars comprise a bar assembly, as shown in FIG. 2, it is contemplated that the top and bottom bars 11A, 11B and 13A, 13B can be secured to one another by any means typically employed for bringing metals together in desirable current-carrying contact. Such means include welding, brazing, clamping and securing by fasterners such as threaded bolts.

The following Example shows a way in which the invention has been practiced but should not be construed as limiting the invention.

EXAMPLE

An electrolytic diaphragm cell for the preparation of caustic andd chlorine from a brine electrolyte and as shown in U.S. Pat. No. 3,390,072 was utilized. The cell selected was one of a number of cells in a cell room which required a side plate replacement. During side plate replacement, the current carrying side was cut through the top and bottom flanges and the side removed. Thereafter, upper and lower steel conductor bars having cross-section, as shown in FIG. 1, i.e., having chamfered weld grooves, were welded to the new side plate. The cell side plate, already having a copper grid bar, was then put back in place in alignment with the tube sheet and the upper and lower bars were welded to the tube sheet. All welding was electric arc welding. Thereafter, both the upper and lower steel flanges were rewelded to the tube sheet and side plate. Again, the welding was electric arc welding. The positioning of the current carrying upper and lower conductor bars was at the top zone and the bottom zone of The copper grid bar, as shown in FIG. 1.

This cell modified in acordance with the present invention was then placed back into service. The cell was observed for six months to provide desirable contiuous operation. At the end of six months, temperature, voltage and catholyte level readings were taken, not only for the cell modified in accordance with the present invention, but also for a similar cell, also in operation in the circuit, but which had not been modified, i.e., a comparative cell. The results of such measurements are shown in the table below. For the cells, the catholyte level is the level as measured, in inches, below the top flange.

TABLE

| | Invention Cell | Comparative Cell |
|---|---|---|
| Catholyte Level | 14 | 18 |
| Voltage | 3.51 | 3.57 |
| T1 | 91–93 | 110–125 |
| T2 | 94–95 | 99–102 |
| T3 | 92–93 | 93–97 |
| T4 | 96–97 | 98–100 |
| Tw | 45 | 45 |

The T1 temperature readings were taken on one side plate, above the grid bar. The T2 temperature was on the same side plate, below the grid bar. T3 was taken on the opposite cell side plate above the grid bar and T4 was taken on the opposite cell side plate below the grid bar. The Tw temperature was for the grid bar at the end of the cell Temperature ranges are shown owing to temperature readings taken over a three hour period. All temperature readings are in degree Centrigrade.

As can be seen from the results in the Table, the cell modified in accordance with the present invention, not only has a desirably lower voltage but also an extremely uniform temperature on both sides. The temperatures on the modified current carrying side have been reduced to the same level as at the cell back side. Such temperature is not only a desirably uniform temperature, but is also a significantly lowered operating temperature as compared with the comparative cell. For each zone of temperature measurement, the comparative cell runs at a more elevated temperature most always a gap up in temperature level. During the recording of the data, no hot spots were located along either cell side for the modified cell. By visual inspection, neither side plate was observed to have any cracks for the modified cell.

We claim:

1. In an electrolytic cell of the diaphragm type useful for producing chlorine and caustic by the electrolysis of brine, wherein said cell comprises a housing containing outer end plates and outer side plates, with said side plates having a longitudinal, outer grid bar as a solid band extending along an outside face of said side plate, at substantially the mid-section thereof, and conducting electrical current to said side plate, and with said side plate in turn being in electrical connection by upper and lower inner flanges to an inner, current-carrying cathode tube sheet situated within said cell housing, with said upper and lower inner flanges extending from said outer side plate to said inner tube sheet and thereby forming a slot therebetween, the improvement in providing side plate temperature uniformity as well as supplementing current flow to said cell comprising an upper distributor bar in firm, electrically conductive connection to both an inner face of said side plate and an outer face of said tube sheet, said upper distributor bar being positioned within said slot below said upper flange and in alignment with the upper edge of said grid bar, and a lower distributor bar in firm electrically conductive connection to both an inner face of said side plate and an outer face of said tube sheet within said slot, with said lower distributor bar being positioned above said lower flange and in alignment with the lower edge of said grid bar, wherein at least one distributor bar comprises an overlapped upper plate and lower plate, said plates being firmly bonded to each other, with one plate being in electrically conductive, welded connection to said outer side plate and the other plate being in the same way connected to said inner tube sheet.

2. The cell of claim 1, wherein said tube sheet is slotted and at least one distributor bar is spaced between said slots.

3. The cell of claim 1, wherein said side plate and said tube sheet are in parallel planes separated by said slot.

4. The cell of claim 1, wherein said distributor bars are solid, longitudinal bars extending along said slot in parallel relationship to said grid bar.

5. In an electrolytic cell of the diaphragm type useful for producing chlorine and caustic by the electrocysis of brine, wherein said cell comprises a housing containing outer end plates and outer side plates, with said side plates having a longitudinal, outer grid bar as a solid band extending along an outside face of said side plate, at substantially the mid-section thereof, and conducting electrical current to said side plate, and with said side plate in turn being in electrical connection by upper and lower inner flanges to an inner, current-carrying cathode tube sheet situated within said cell housing, with said upper and lower inner flanges extending from said outer side plate to said inner tube sheet and thereby forming a slot therebetween, the improvement in providing side plate temperature uniformity as well as supplementing current flow to said cell comprising an upper distributor bar in firm, electrically conductive connection to both an inner face of said side plate and outer face of said tube sheet, said upper distributor bar being positioned within said slot below said upper flange and in alignment with the upper edge of said grid bar, and a lower distributor bar in firm electrically conductive connection to both an inner face of said side plate and an outer face of said tube sheet within said slot, with said lower distributor bar being positioned above said lower flange and in alignment with the lower edge of said grid bar, wherein said upper and lower distributor bars are of substantially rectangular cross-section and said bars are welded along weld grooves to the inner face of said plate and the outer face of said tube sheet.

6. The cell of claim 5, wherein said tube sheet is slotted and at least one distributor bar is spaced between said slots.

7. The cell of claim 5, wherein said side plate and said tube sheet are in parallel planes separated by said slot.

8. The cell of claim 5, wherein said distributor bars are solid, longitudinal bars extending along said slot in parallel relationship to said grid bar.

9. The cell of claim 5, wherein said weld grooves are chamfered weld grooves.

* * * * *